US009859043B2

(12) United States Patent
Yan et al.

(10) Patent No.: US 9,859,043 B2
(45) Date of Patent: Jan. 2, 2018

(54) MAGNETIC COMPONENTS AND METHODS OF MANUFACTURING THE SAME

(75) Inventors: Yipeng Yan, Shanghai (CN); Robert James Bogert, Lake Worth, FL (US)

(73) Assignee: COOPER TECHNOLOGIES COMPANY, Houston, TX (US)

( * ) Notice: Subject to any disclaimer, the term of this patent is extended or adjusted under 35 U.S.C. 154(b) by 579 days.

(21) Appl. No.: 12/765,115

(22) Filed: Apr. 22, 2010

(65) Prior Publication Data

US 2010/0271161 A1 Oct. 28, 2010

Related U.S. Application Data

(63) Continuation-in-part of application No. 12/247,821, filed on Oct. 8, 2008, now Pat. No. 8,310,332.

(Continued)

(51) Int. Cl.

| | |
|---|---|
| ***H01F 5/00*** | (2006.01) |
| ***H01F 17/04*** | (2006.01) |
| ***H01F 27/24*** | (2006.01) |
| ***H01F 1/26*** | (2006.01) |
| ***H01F 41/02*** | (2006.01) |
| *H01F 1/14* | (2006.01) |
| *H01F 1/147* | (2006.01) |
| *H01F 1/153* | (2006.01) |

(Continued)

(52) U.S. Cl.

CPC ..... *H01F 1/26* (2013.01); *H01F 17/04* (2013.01); *H01F 41/0246* (2013.01); *H01F 1/14* (2013.01); *H01F 1/14758* (2013.01); *H01F 1/14791* (2013.01); *H01F 1/15375* (2013.01); *H01F 1/37* (2013.01); *H01F 3/10* (2013.01); *H01F 27/255* (2013.01); *H01F 27/2847* (2013.01); *H01F 2017/046* (2013.01); *H01F 2017/048* (2013.01)

(58) Field of Classification Search

CPC ..... H01F 1/26; H01F 1/14; H01F 1/14758; H01F 1/14791; H01F 1/15375; H01F 1/37; H01F 17/04; H01F 41/0246; H01F 27/255; H01F 27/2847; H01F 2017/046; H01F 2017/048

USPC ..... 336/192, 200, 212, 222, 223, 232, 234, 336/221, 233

See application file for complete search history.

(56) References Cited

U.S. PATENT DOCUMENTS

| | | | |
|---|---|---|---|
| 2,391,563 | A | 12/1945 | Goldberg |
| 3,255,512 | A | 6/1966 | Lochner et al. |

(Continued)

FOREIGN PATENT DOCUMENTS

| | | |
|---|---|---|
| DE | 8132269 | 1/1986 |
| EP | 0655754 A1 | 5/1995 |

(Continued)

OTHER PUBLICATIONS

International Search Report and Written Opinion of PCT/US2010/032803; dated Aug. 23, 2010; 16 pages.

(Continued)

*Primary Examiner* — Mangtin Lian

(74) *Attorney, Agent, or Firm* — Armstrong Teasdale LLP

(57) ABSTRACT

Magnetic component assemblies including moldable magnetic materials formed into magnetic bodies, at least one conductive coil, and termination features are disclosed that are advantageously utilized in providing surface mount magnetic components such as inductors and transformers.

31 Claims, 12 Drawing Sheets

Related U.S. Application Data

(60) Provisional application No. 61/175,269, filed on May 4, 2009, provisional application No. 61/080,115, filed on Jul. 11, 2008.

(51) Int. Cl.

| | |
|---|---|
| *H01F 1/37* | (2006.01) |
| *H01F 3/10* | (2006.01) |
| *H01F 27/255* | (2006.01) |
| *H01F 27/28* | (2006.01) |

(56) References Cited

U.S. PATENT DOCUMENTS 4,072,780 A 2/1978 Zillman
4,313,152 A 1/1982 Vranken
4,322,698 A 3/1982 Takahashi et al.
4,543,553 A 9/1985 Mandai et al.
4,689,594 A 8/1987 Kawabata et al.
4,750,077 A 6/1988 Amagasa
4,758,808 A 7/1988 Sasaki et al.
4,803,425 A 2/1989 Swanberg
4,873,757 A 10/1989 Williams
5,032,815 A 7/1991 Kobayashi et al.
5,045,380 A 9/1991 Kobayashi et al.
5,250,923 A 10/1993 Ushiro et al.
5,257,000 A 10/1993 Billings et al.
5,300,911 A 4/1994 Walters
5,463,717 A 10/1995 Takatori et al.
5,500,629 A 3/1996 Meyer
5,515,022 A 5/1996 Tashiro et al.
5,532,667 A 7/1996 Haertling et al.
5,572,180 A 11/1996 Huang et al.
5,578,981 A * 11/1996 Tokuda ..... 336/171
5,664,069 A 9/1997 Takatori et al.
5,761,791 A 6/1998 Bando
5,821,638 A 10/1998 Boys et al.
5,849,355 A 12/1998 McHenry
5,875,541 A 3/1999 Kumeji et al.
5,912,609 A 6/1999 Usui et al.
5,945,902 A 8/1999 Lipkes et al.
6,038,134 A 3/2000 Belter
6,054,914 A 4/2000 Abel et al.
6,107,907 A * 8/2000 Leigh et al. ..... 336/200
6,114,939 A 9/2000 Wittenbreder
6,137,389 A * 10/2000 Uchikoba ..... 336/83
6,169,801 B1 1/2001 Levasseur et al.
6,198,374 B1 3/2001 Abel
6,198,375 B1 3/2001 Shafer
6,204,744 B1 3/2001 Shafer et al.
6,287,931 B1 9/2001 Chen
6,293,001 B1 9/2001 Uriu et al.
6,366,192 B2 4/2002 Person et al.
6,379,579 B1 4/2002 Harada
6,392,525 B1 * 5/2002 Kato et al. ..... 336/233
6,404,317 B1 * 6/2002 Mizoguchi et al. ..... 336/200
6,420,953 B1 7/2002 Dadafshar
6,449,829 B1 9/2002 Shafer
6,460,244 B1 10/2002 Shafer et al.
6,566,731 B2 5/2003 Ahn et al.
6,603,382 B1 * 8/2003 Komai et al. ..... 336/200
6,628,531 B2 9/2003 Dadafshar
6,631,545 B1 10/2003 Uriu et al.
6,653,196 B2 11/2003 Ahn et al.
6,658,724 B2 12/2003 Nakano et al.
6,690,164 B1 * 2/2004 Fedeli et al. ..... 324/253
6,710,692 B2 3/2004 Kato et al.
6,713,162 B2 * 3/2004 Takaya et al. ..... 428/209
6,720,074 B2 4/2004 Xiao et al.
6,749,827 B2 6/2004 Smalley et al.
6,750,723 B2 6/2004 Yoshida et al.
6,791,445 B2 9/2004 Shibata et al.
6,794,052 B2 9/2004 Schultz et al.
6,797,336 B2 9/2004 Garvey et al.
6,808,642 B2 10/2004 Takaya et al.
6,817,085 B2 11/2004 Uchikoba et al.
6,835,889 B2 12/2004 Hiraoka et al.
6,859,994 B2 * 3/2005 Oshima et al. ..... 29/602.1
6,864,201 B2 3/2005 Schultz et al.
6,879,238 B2 4/2005 Liu et al.
6,882,261 B2 4/2005 Moro et al.
6,885,276 B2 4/2005 Iha et al.
6,897,718 B2 5/2005 Yoshida et al.
6,908,960 B2 6/2005 Takaya et al.
6,927,738 B2 8/2005 Senba et al.
6,936,233 B2 8/2005 Smalley et al.
6,946,944 B2 9/2005 Shafer et al.
6,949,237 B2 9/2005 Smalley et al.
6,952,355 B2 10/2005 Riggio et al.
6,971,391 B1 12/2005 Wang et al.
6,979,709 B2 12/2005 Smalley et al.
6,986,876 B2 1/2006 Smalley et al.
7,008,604 B2 3/2006 Smalley et al.
7,019,391 B2 3/2006 Tran
7,034,091 B2 4/2006 Schultz et al.
7,034,645 B2 4/2006 Shafer et al.
7,041,620 B2 5/2006 Smalley et al.
7,048,999 B2 5/2006 Smalley et al.
7,069,639 B2 * 7/2006 Choi et al. ..... 29/602.1
7,071,406 B2 7/2006 Smalley et al.
7,078,999 B2 7/2006 Uriu et al.
7,081,803 B2 7/2006 Takaya et al.
7,087,207 B2 8/2006 Smalley et al.
7,091,412 B2 8/2006 Wang et al.
7,091,575 B2 8/2006 Ahn et al.
7,105,596 B2 9/2006 Smalley et al.
7,108,841 B2 9/2006 Smalley et al.
7,127,294 B1 10/2006 Wang et al.
7,142,066 B1 11/2006 Hannah et al.
7,162,302 B2 1/2007 Wang et al.
7,187,263 B2 3/2007 Vinciarelli
7,205,069 B2 4/2007 Smalley et al.
7,213,915 B2 5/2007 Tsutsumi et al.
7,221,249 B2 5/2007 Shafer et al.
7,262,482 B2 8/2007 Ahn et al.
7,263,761 B1 9/2007 Shafer et al.
7,294,366 B2 11/2007 Renn et al.
7,319,599 B2 1/2008 Hirano et al.
7,330,369 B2 2/2008 Tran
7,339,451 B2 3/2008 Liu et al.
7,345,562 B2 3/2008 Shafer et al.
7,354,563 B2 4/2008 Smalley et al.
7,375,417 B2 5/2008 Tran
7,380,328 B2 6/2008 Ahn et al.
7,390,477 B2 6/2008 Smalley et al.
7,390,767 B2 6/2008 Smalley et al.
7,393,699 B2 7/2008 Tran
7,400,512 B2 7/2008 Hirano et al.
7,419,624 B1 9/2008 Smalley et al.
7,419,651 B2 9/2008 Smalley et al.
7,442,665 B2 10/2008 Schultz et al.
7,445,852 B2 11/2008 Maruko et al.
7,481,989 B2 1/2009 Smalley et al.
7,485,366 B2 2/2009 Ma et al.
7,489,537 B2 2/2009 Tran
7,567,163 B2 7/2009 Dadafshar et al.
7,707,714 B2 * 5/2010 Schmidt et al. ..... 29/842
7,791,445 B2 9/2010 Manoukian et al.
8,022,804 B2 * 9/2011 Pilniak et al. ..... 336/222
2001/0016977 A1 8/2001 Moro et al.
2001/0043135 A1 11/2001 Yamada et al.
2002/0009577 A1 1/2002 Takaya et al.
2002/0067234 A1 6/2002 Kung
2002/0121957 A1 9/2002 Takashima et al.
2003/0029830 A1 2/2003 Takaya et al.
2003/0048167 A1 * 3/2003 Inoue et al. ..... 336/200
2003/0184423 A1 10/2003 Holdahl et al.
2004/0017276 A1 1/2004 Chen et al.
2004/0174239 A1 9/2004 Shibata et al.
2004/0189430 A1 9/2004 Matsutani et al.
2004/0209120 A1 10/2004 Inoue et al.
2004/0210289 A1 10/2004 Wang et al.
2005/0012581 A1 1/2005 Ono et al.
2005/0151614 A1 7/2005 Dadafshar

(56) References Cited

U.S. PATENT DOCUMENTS

| | | | | |
|---|---|---|---|---|
| 2005/0174207 | A1 | 8/2005 | Young et al. | |
| 2005/0184848 | A1 | 8/2005 | Yoshida et al. | |
| 2005/0188529 | A1 | 9/2005 | Uriu et al. | |
| 2006/0001517 | A1 | 1/2006 | Cheng | |
| 2006/0038651 | A1 | 2/2006 | Mizushima et al. | |
| 2006/0049906 | A1 | 3/2006 | Liu et al. | |
| 2006/0145800 | A1 | 7/2006 | Dadafshar et al. | |
| 2006/0145804 | A1 | 7/2006 | Matsutani et al. | |
| 2006/0186975 | A1 | 8/2006 | Wang | |
| 2006/0186978 | A1 | 8/2006 | Kawarai | |
| 2006/0214759 | A1* | 9/2006 | Kawarai | 336/200 |
| 2007/0030108 | A1 | 2/2007 | Ishimoto et al. | |
| 2007/0057755 | A1 | 3/2007 | Suzuki et al. | |
| 2007/0163110 | A1 | 7/2007 | Sutardja | |
| 2007/0252669 | A1 | 11/2007 | Hansen et al. | |
| 2008/0001702 | A1 | 1/2008 | Brunner | |
| 2008/0012679 | A1 | 1/2008 | Okabe et al. | |
| 2008/0061917 | A1 | 3/2008 | Manoukian et al. | |
| 2008/0110014 | A1 | 5/2008 | Shafer et al. | |
| 2008/0252409 | A1* | 10/2008 | Kojima | 336/185 |
| 2008/0278275 | A1 | 11/2008 | Fouquet et al. | |
| 2008/0310051 | A1 | 12/2008 | Yan et al. | |
| 2009/0058588 | A1 | 3/2009 | Suzuki et al. | |
| 2009/0179723 | A1 | 7/2009 | Ikriannikov et al. | |
| 2009/0302512 | A1 | 12/2009 | Gablenz et al. | |
| 2010/0007451 | A1 | 1/2010 | Yan et al. | |
| 2010/0007453 | A1 | 1/2010 | Yan et al. | |
| 2010/0007457 | A1 | 1/2010 | Yan et al. | |
| 2010/0013587 | A1 | 1/2010 | Yan et al. | |
| 2010/0026443 | A1 | 2/2010 | Yan et al. | |
| 2010/0039200 | A1 | 2/2010 | Yan et al. | |
| 2010/0085139 | A1 | 4/2010 | Yan et al. | |
| 2010/0171581 | A1 | 7/2010 | Manoukian et al. | |
| 2010/0259351 | A1 | 10/2010 | Bogert et al. | |
| 2010/0259352 | A1 | 10/2010 | Yan et al. | |
| 2010/0277267 | A1 | 11/2010 | Bogert et al. | |

FOREIGN PATENT DOCUMENTS

| | | | |
|---|---|---|---|
| EP | 0785557 | A1 | 7/1997 |
| EP | 1150312 | A2 | 10/2001 |
| EP | 1288975 | A2 | 3/2003 |
| EP | 1486991 | A1 | 12/2004 |
| EP | 1526556 | A1 | 4/2005 |
| EP | 1564761 | A1 | 8/2005 |
| EP | 1833063 | A1 | 9/2007 |
| FR | 2556493 | A1 | 6/1985 |
| GB | 2044550 | A | 10/1980 |
| JP | 6423121 | | 2/1989 |
| JP | 1266705 | | 10/1989 |
| JP | 03241711 | | 10/1991 |
| JP | 05291046 | | 5/1993 |
| JP | 06216538 | | 8/1994 |
| JP | 07272932 | | 10/1995 |
| JP | 2700713 | | 1/1998 |
| JP | 10106839 | | 4/1998 |
| JP | 2000182872 | | 6/2000 |
| JP | 3108931 | | 11/2000 |
| JP | 3160685 | | 4/2001 |
| JP | 2002043143 | | 2/2002 |
| JP | 2002280745 | | 9/2002 |
| JP | 2002313632 | | 10/2002 |
| JP | 2004200468 | | 7/2004 |
| JP | 2005129968 | | 5/2005 |
| JP | 2007227914 | | 9/2007 |
| JP | 2008078178 | | 4/2008 |
| KR | 20010014533 | | 2/2001 |
| KR | 20020071285 | | 9/2002 |
| KR | 20030081738 | | 10/2003 |
| WO | 9205568 | | 4/1992 |
| WO | 9704469 | | 2/1997 |
| WO | 0191141 | A1 | 11/2001 |
| WO | 2005008692 | A2 | 1/2005 |
| WO | 2005024862 | A1 | 3/2005 |
| WO | 2006063081 | A2 | 6/2006 |
| WO | 2008008538 | A2 | 1/2008 |
| WO | 2008152493 | A2 | 12/2008 |
| WO | 2009113775 | A2 | 9/2009 |

OTHER PUBLICATIONS

EMI Suppression Sheets (PE Series); http://www.fdk.com.jp; 1 page.

Kelley, A., et al; Plastic-Iron-Powder Distributed-Air-Gap Magnetic Material; Power Electronics Specialists Conference; 1990; PESC '90 Record; 21st Annual IEEE; 1990-06-11-14; pp. 25-34; San Antonio, TX.

Ferrite Polymer Composite (FPC) Film; http:// www.epcos.com/inf/80/ap/e0001000.htm; 1999 EPCOS; 8 pages.

Yoshida, S., et al.; Permeability and Electromagnetic-Interference Characteristics for Fe—Si—Al Alloy Flakes-Polymer Composite; Journal of Applied Physics; Apr. 15, 1999; pp. 4636-4638; vol. 85, No. 8; American Institute of Physics.

Heinrichs, F., et al.; Elements to Achieve Automotive Power; www.powersystemsdesign.com; Oct. 2004; pp. 37-40; Power Systems Design Europe.

Kim, S. et al; Electromagnetic Shielding Properties of Soft Magnetic Powder-Polymer Composite Films for the Application to Suppress Noise in the Radio Frequency Range; www.sciencedirect.com; Journal of Magnetism and Magnetic Materials 316 (2007) 472-474.

VISA—Technology; http://130.149.194.207/visa-projekt/technology/technology.htm; Federal Ministry of Education and Research; Jan. 21, 2009. 1 page.

Waffenschmidt, E.; Visa—The Concept; http://130.149.194.207/visa-projekt/technology/concept.htm; Federal Ministry of Education and Research; Jan. 21, 2009. 2 pages.

Waffenschmidt, E.; VISA—Ferrite Polymer Compounds; http://130.149.194.207/visa-projekt/technology/ferrite_polymers.htm; Federal Ministry of Education and Research; Jan. 21, 2009. 2 pages.

Visa—Overview; http://130.149.194.207/visa-projekt/index.htm; Federal Ministry of Education and Research; Jan. 23, 2009. 1 page.

International Search Report and Written Opinion of PCT/US2011/024714; dated Apr. 21, 2011; 14 pages.

International Preliminary Report on Patentability of PCT/US2009/057471; dated Apr. 21, 2011; 6 pages.

International Search Report and Written Opinion of PCT/US2010/032798; dated Aug. 20, 2010; 15 pages.

International Search Report and Written Opinion of PCT/US2010/031886; dated Aug. 18, 2010; 14 pages.

International Search Report and Written Opinion of PCT/US2010/032517; dated Aug. 12, 2010; 16 pages.

International Search Report and Written Opinion of PCT/US2010/032414; dated Aug. 11, 2010; 15 pages.

International Search Report and Written Opinion of PCT/US2010/032407; dated Aug. 2, 2010; 19 pages.

International Search Report and Written Opinion of PCT/US2010/032992; dated Jul. 28, 2010; 15 pages.

International Search Report and Written Opinion of PCT/US2010/032540; dated Jul. 27, 2010; 20 pages.

International Search Report and Written Opinion of PCT/US2010/033006; dated Jul. 15, 2010; 18 pages.

International Search Report and Written Opinion of PCT/US2010/032787; dated Jul. 14, 2010; 20 pages.

International Search Report and Written Opinion of PCT/US2009/057471; dated Dec. 14, 2009; 14 pages.

International Search Report and Written Opinion of PCT/US20091051005; dated Sep. 23, 2009; 15 pages.

VISA—Literatur; http://130.149.194.207/visa-projekt/literatur.htm; Federal Ministry of Education and Research; Jan. 23, 2009. 11 pages.

* cited by examiner

MAGNETIC COMPONENTS AND METHODS OF MANUFACTURING THE SAME

CROSS REFERENCE TO RELATED APPLICATIONS

This application claims the benefit of U.S. Provisional Application Ser. No. 61/175,269 filed May 4, 2009, is continuation in part application of U.S. application Ser. No. 12/247,821 filed Oct. 8, 2008 now U.S. Pat. No. 8,310,332, and also claims the benefit of U.S. Provisional Patent Application No. 61/080,115 filed Jul. 11, 2008, the complete disclosures of which are hereby incorporated by reference in their entirety.

The present application also relates to subject matter disclosed in the following commonly owned and co-pending patent applications: U.S. patent application Ser. No. 12/429,856 filed Apr. 24, 2009 and entitled "Surface Mount Magnetic Component Assembly", now issued U.S. Pat. No. 7,986,208; U.S. patent Ser. No. 12/181,436 filed Jul. 29, 2008 and entitled "A Magnetic Electrical Device"; U.S. patent application Ser. No. 12/138,792 filed Jun. 13, 2008 and entitled "Miniature Shielded Magnetic Component"; and U.S. patent application Ser. No. 11/519,349 filed Jun. Sep. 12, 2006 and entitled "Low Profile Layered Coil and Cores for Magnetic Components", now issued U.S. Pat. No. 7,791,945.

BACKGROUND OF THE INVENTION

The field of the invention relates generally to magnetic components and their manufacture, and more specifically to magnetic, surface mount electronic components such as inductors and transformers.

With advancements in electronic packaging, the manufacture of smaller, yet more powerful, electronic devices has become possible. To reduce an overall size of such devices, electronic components used to manufacture them have become increasingly miniaturized. Manufacturing electronic components to meet such requirements presents many difficulties, thereby making manufacturing processes more expensive, and undesirably increasing the cost of the electronic components.

Manufacturing processes for magnetic components such as inductors and transformers, like other components, have been scrutinized as a way to reduce costs in the highly competitive electronics manufacturing business. Reduction of manufacturing costs is particularly desirable when the components being manufactured are low cost, high volume components. In high volume, mass production processes for such components, and also electronic devices utilizing the components, any reduction in manufacturing costs is, of course, significant.

BRIEF DESCRIPTION OF THE INVENTION

Exemplary embodiments of magnetic component assemblies and methods of manufacturing the assemblies are disclosed herein that are advantageously utilized to achieve one or more of the following benefits: component structures that are more amenable to produce at a miniaturized level; component structures that are more easily assembled at a miniaturized level; component structures that allow for elimination of manufacturing steps common to known magnetic constructions; component structures having an increased reliability via more effective manufacturing techniques; component structures having improved performance in similar or reduced package sizes compared to existing magnetic components; component structures having increased power capability compared to conventional, miniaturized, magnetic components; and component structures having unique core and coil constructions offering distinct performance advantages relative to known magnetic component constructions.

The exemplary component assemblies are believed to be particularly advantageous to construct inductors and transformers, for example. The assemblies may be reliably provided in small package sizes and may include surface mount features for ease of installation to circuit boards.

BRIEF DESCRIPTION OF THE DRAWINGS

Non-limiting and non-exhaustive embodiments are described with reference to the following Figures, wherein like reference numerals refer to like parts throughout the various drawings unless otherwise specified.

DETAILED DESCRIPTION OF THE INVENTION

Figure 1:
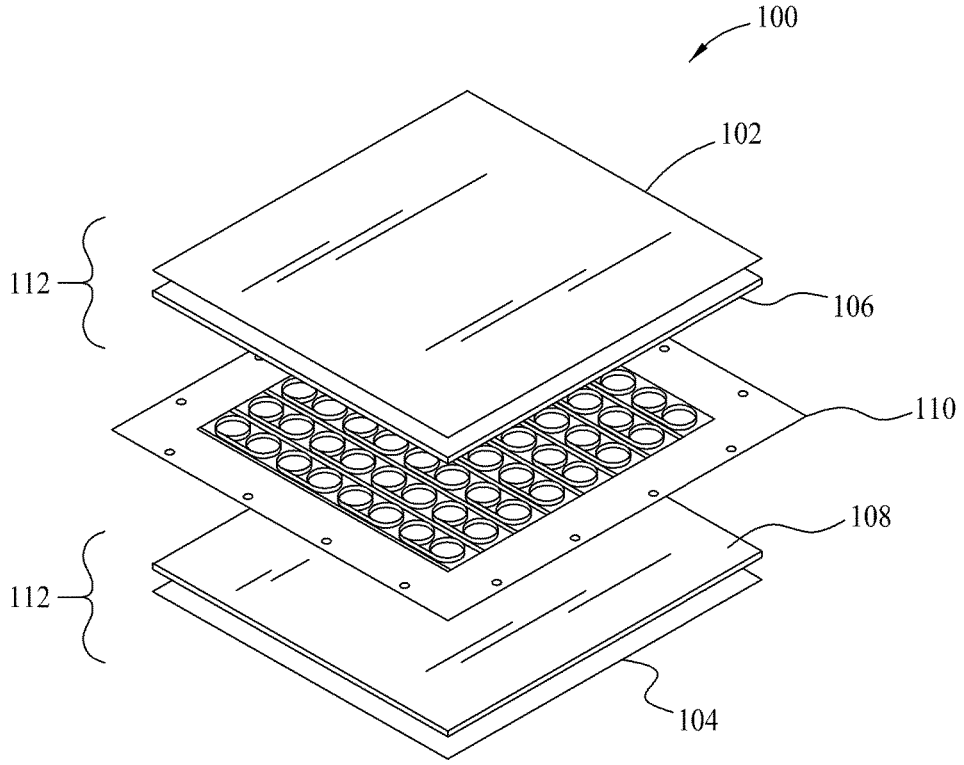
FIG. 1 is an exploded view of a first exemplary magnetic component assembly formed in accordance with an exemplary embodiment of the invention.

Exemplary embodiments of inventive electronic component designs are described herein that overcome numerous difficulties in the art. To understand the invention to its fullest extent, the following disclosure is presented in different segments or parts, wherein Part I discusses particular problems and difficulties, and Part II describes exemplary component constructions and assemblies for overcoming such problems.

I. INTRODUCTION TO THE INVENTION

Conventional magnetic components such as inductors for circuit board applications typically include a magnetic core and a conductive winding, sometimes referred to as a coil, within the core. The core may be fabricated from discrete core pieces fabricated from magnetic material with the winding placed between the core pieces. Various shapes and types of core pieces and assemblies are familiar to those in the art, including but not necessarily limited to U core and I core assemblies, ER core and I core assemblies, ER core and ER core assemblies, a pot core and T core assemblies, and other matching shapes. The discrete core pieces may be bonded together with an adhesive and typically are physically spaced or gapped from one another.

In some known components, for example, the coils are fabricated from a conductive wire that is wound around the core or a terminal clip. That is, the wire may be wrapped around a core piece, sometimes referred to as a drum core or other bobbin core, after the core pieces has been completely formed. Each free end of the coil may be referred to as a lead and may be used for coupling the inductor to an electrical circuit, either via direct attachment to a circuit board or via an indirect connection through a terminal clip. Especially for small core pieces, winding the coil in a cost effective and reliable manner is challenging. Hand wound components tend to be inconsistent in their performance. The shape of the core pieces renders them quite fragile and prone to core cracking as the coil is wound, and variation in the gaps between the core pieces can produce undesirable variation in component performance. A further difficulty is that the DC resistance ("DCR") may undesirably vary due to uneven winding and tension during the winding process.

In other known components, the coils of known surface mount magnetic components are typically separately fabricated from the core pieces and later assembled with the core pieces. That is, the coils are sometimes referred to as being pre-formed or pre-wound to avoid issues attributable to hand winding of the coil and to simplify the assembly of the magnetic components. Such pre-formed coils are especially advantageous for small component sizes.

In order to make electrical connection to the coils when the magnetic components are surface mounted on a circuit board, conductive terminals or clips are typically provided. The clips are assembled on the shaped core pieces and are electrically connected to the respective ends of the coil. The terminal clips typically include generally flat and planar regions that may be electrically connected to conductive traces and pads on a circuit board using, for example, known soldering techniques. When so connected and when the circuit board is energized, electrical current may flow from the circuit board to one of the terminal clips, through the coil to the other of the terminal clips, and back to the circuit board. In the case of an inductor, current flow through the coil induces magnetic fields and energy in the magnetic core. More than one coil may be provided.

In the case of a transformer, a primary coil and a secondary coil are provided, wherein current flow through the primary coil induces current flow in the secondary coil. The manufacture of transformer components presents similar challenges as inductor components.

For increasingly miniaturized components, providing physically gapped cores is challenging. Establishing and maintaining consistent gap sizes is difficult to reliably accomplish in a cost effective manner.

A number of practical issues are also presented with regard to making the electrical connection between the coils and the terminal clips in miniaturized, surface mount magnetic components. A rather fragile connection between the coil and terminal clips is typically made external to the core and is consequently vulnerable to separation. In some cases, it is known to wrap the ends of coil around a portion of the clips to ensure a reliable mechanical and electrical connection between the coil and the clips. This has proven tedious, however, from a manufacturing perspective and easier and quicker termination solutions would be desirable. Additionally, wrapping of the coil ends is not practical for certain types of coils, such as coils having rectangular cross section with flat surfaces that are not as flexible as thin, round wire constructions.

As electronic devices continue recent trends of becoming increasingly powerful, magnetic components such as inductors are also required to conduct increasing amounts of current. As a result the wire gauge used to manufacture the coils is typically increased. Because of the increased size of the wire used to fabricate the coil, when round wire is used to fabricate the coil the ends are typically flattened to a suitable thickness and width to satisfactorily make the mechanical and electrical connection to the terminal clips using for example, soldering, welding, or conductive adhesives and the like. The larger the wire gauge, however, the more difficult it is to flatten the ends of the coil to suitably connect them to the terminal clips. Such difficulties have resulted in inconsistent connections between the coil and the terminal clips that can lead to undesirable performance issues and variation for the magnetic components in use. Reducing such variation has proven very difficult and costly.

Fabricating the coils from flat, rather than round conductors may alleviate such issues for certain applications, but flat conductors tend to be more rigid and more difficult to form into the coils in the first instance and thus introduce other manufacturing issues. The use of flat, as opposed to round, conductors can also alter the performance of the component in use, sometimes undesirably. Additionally, in some known constructions, particularly those including coils fabricated from flat conductors, termination features such as hooks or other structural features may be formed into the ends of the coil to facilitate connections to the terminal clips. Forming such features into the ends of the coils, however, can introduce further expenses in the manufacturing process.

Recent trends to reduce the size, yet increase the power and capabilities of electronic devices present still further challenges. As the size of electronic devices are decreased, the size of the electronic components utilized in them must accordingly be reduced, and hence efforts have been directed to economically manufacture power inductors and transformers having relatively small, sometimes miniaturized, structures despite carrying an increased amount of electrical current to power the device. The magnetic core structures are desirably provided with lower and lower profiles relative to circuit boards to allow slim and sometimes very thin profiles of the electrical devices. Meeting such requirement presents still further difficulties. Still other difficulties are presented for components that are connected to multi-phase electrical power systems, wherein accommodating different phases of electrical power in a miniaturized device is difficult.

Efforts to optimize the footprint and the profile of magnetic components are of great interest to component manufacturers looking to meet the dimensional requirements of modern electronic devices. Each component on a circuit board may be generally defined by a perpendicular width and depth dimension measured in a plane parallel to the circuit board, the product of the width and depth determining the surface area occupied by the component on the circuit board, sometimes referred to as the "footprint" of the component. On the other hand, the overall height of the component, measured in a direction that is normal or perpendicular to the circuit board, is sometimes referred to as the "profile" of the component. The footprint of the components in part determines how many components may be installed on a circuit board, and the profile in part determines the spacing allowed between parallel circuit boards in the electronic device. Smaller electronic devices generally require more components to be installed on each circuit board present, a reduced clearance between adjacent circuit boards, or both.

However, many known terminal clips used with magnetic components have a tendency to increase the footprint and/or the profile of the component when surface mounted to a circuit board. That is, the clips tend to extend the depth, width and/or height of the components when mounted to a circuit board and undesirably increase the footprint and/or profile of the component. Particularly for clips that are fitted over the external surfaces of the magnetic core pieces at the top, bottom or side portions of the core, the footprint and/or profile of the completed component may be extended by the terminal clips. Even if the extension of the component profile or height is relatively small, the consequences can be substantial as the number of components and circuit boards increases in any given electronic device.

II. EXEMPLARY INVENTIVE MAGNETIC COMPONENT ASSEMBLIES AND METHODS OF MANUFACTURE

Exemplary embodiments of magnetic component assemblies will now be discussed that address some of the problems of conventional magnetic components in the art. For discussion purposes, exemplary embodiments of the component assemblies and methods of manufacture are discussed collectively in relation to common design features addressing specific concerns in the art, although it should be understood that the exemplary embodiments discussed are not necessarily exclusive to the categories set for the below.

Manufacturing steps associated with the devices described are in part apparent and in part specifically described below. Likewise, devices associated with method steps described are in part apparent and in part explicitly described below. That is the devices and methodology of the invention will not necessarily be separately described in the discussion below, but are believed to be well within the purview of those in the art without further explanation.

Various embodiments of magnetic components are described below including magnetic body constructions and coil constructions that provide manufacturing and assembly advantages over existing magnetic components. As will be appreciated below, the advantages are provided at least in part because of the magnetic materials utilized which may be molded over the coils, thereby eliminating assembly steps of discrete, gapped cores and coils. Also, the magnetic materials have distributed gap properties that avoids any need to physically gap or separate different pieces of magnetic materials. As such, difficulties and expenses associated with establishing and maintaining consistent physical gap sizes are advantageously avoided. Still other advantages are in part apparent and in part pointed out hereinafter.

As shown in FIG. 1, a magnetic component assembly 100 is fabricated in a layered construction wherein multiple layers are stacked and assembled in a batch process.

The assembly 100 as illustrated includes a plurality of layers including outer magnetic layers 102 and 104, inner magnetic layers 106 and 108, and a coil layer 110. The inner magnetic layers 106 and 108 are positioned on opposing sides of the coil layer 110 and sandwich the coil layer 110 in between. The outer magnetic layers 102 and 104 are positioned on surfaces of the inner magnetic layers 106 and 108 opposite the coil layer 110.

In an exemplary embodiment each of the magnetic layers 102, 104, 106 and 108 is fabricated from a moldable magnetic material which may be, for example, a mixture of magnetic powder particles and a polymeric binder having distributed gap properties as those in the art will no doubt appreciate. The magnetic layers 102, 104, 106 and 108 may accordingly be pressed around the coil layer 110, and pressed to one another, to form an integral or monolithic magnetic body 112 above, below and around the coil layer 110. While four magnetic layers and one coil layer are shown, it is contemplated that greater or fewer numbers of magnetic layers and more than one coil layer 110 could be utilized in further and/or alternative embodiments.

The coil layer 110, as shown in FIG. 1 includes a plurality of coils, sometimes also referred to as windings. Any number of coils may be utilized in the coil layer 110. The coils in the coil layer 110 may be fabricated from conductive materials in any manner, including but not limited to those described in the related commonly owned patent applications referenced above. For example, the coil layer 110 in different embodiments may each be formed from flat wire conductors wound about an axis for a number of turns, round wire conductors wound about an axis for a number of turns, or by printing techniques and the like on rigid or flexible substrate materials.

Each coil in the coil layer 110 may include any number of turns or loops, including fractional or partial turns less than one complete turn, to achieve a desired magnetic effect, such as an inductance value for a magnetic component. The turns or loops may include a number of straight conductive paths joined at their ends, curved conductive paths, spiral conductive paths, serpentine conductive paths or still other known shapes and configurations. The coils in the coil layer 110 may be formed as generally planar elements, or may alternatively be formed as a three dimensional, freestanding coil element. In the latter case where freestanding coil elements are used, the freestanding elements may be coupled to a lead frame for manufacturing purposes.

The magnetic powder particles used to form the magnetic layers 102, 104, 106 and 108 may be, in various embodiments, Ferrite particles, Iron (Fe) particles, Sendust (Fe—Si—Al) particles, MPP (Ni—Mo—Fe) particles, HighFlux (Ni—Fe) particles, Megaflux (Fe—Si Alloy) particles, iron-based amorphous powder particles, cobalt-based amorphous powder particles, or other equivalent materials known in the art. When such magnetic powder particles are mixed with a polymeric binder material the resultant magnetic material exhibits distributed gap properties that avoids any need to physically gap or separate different pieces of magnetic materials. As such, difficulties and expenses associated with establishing and maintaining consistent physical gap sizes are advantageously avoided. For high current applications, a pre-annealed magnetic amorphous metal powder combined with a polymer binder is believed to be advantageous.

In different embodiments, the magnetic layers 102, 104, 106 and 108 may be fabricated from the same type of magnetic particles or different types of magnetic particles. That is, in one embodiment, all the magnetic layers 102, 104, 106 and 108 may be fabricated from one and the same type of magnetic particles such that the layers 102, 104, 106 and 108 have substantially similar, if not identical, magnetic properties. In another embodiment, however, one or more of the layers 102, 104, 106 and 108 could be fabricated from a different type of magnetic powder particle than the other layers. For example, the inner magnetic layers 106 and 108 may include a different type of magnetic particles than the outer magnetic layers 102 and 104, such that the inner layers 106 and 108 have different properties from the outer magnetic layers 102 and 104. The performance characteristics of completed components may accordingly be varied depending on the number of magnetic layers utilized and the type of magnetic materials used to form each of the magnetic layers.

As FIG. 1 illustrates, the magnetic layers 102, 104, 106 and 108 may be provided in relatively thin sheets that may be stacked with the coil layer 110 and joined to one another in a lamination process or via other techniques known in the art. The magnetic layers 102, 104, 106 and 108 may be prefabricated at a separate stage of manufacture to simplify the formation of the magnetic component at a later assembly stage.

Additionally, the magnetic material is beneficially moldable into a desired shape through, for example, compression molding techniques or other techniques to coupled the layers to the coil and to define the magnetic body into a desired shape. The ability to mold the material is advantageous in that the magnetic body can be formed around the coil layer(s) 110 in an integral or monolithic structure including the coil, and a separate manufacturing step of assembling the coil(s) to a magnetic structure is avoided. Various shapes of magnetic bodies may be provided in various embodiments.

Once the component assembly 100 is secured together, the assembly 100 may be cut, diced, singulated or otherwise separated into discrete, individual components. Each component may include a single coil or multiple coils depending on the desired end use or application. Surface mount termination structure, such as any of the termination structures described in the related applications or discussed below, may be provided to the assembly 100 before or after the components are singulated. The components may be mounted to a surface of a circuit board using known soldering techniques and the like to establish electrical connections between the circuitry on the boards and the coils in the magnetic components.

The components may be specifically adapted for use as transformers or inductors in direct current (DC) power applications, single phase voltage converter power applications, two phase voltage converter power applications, three phase voltage converter power applications, and multi-phase power applications. In various embodiments, the coils may be electrically connected in series or in parallel, either in the components themselves or via circuitry in the boards on which they are mounted, to accomplish different objectives.

When two or more independent coils are provided in one magnetic component, the coils may be arranged so that there is flux sharing between the coils. That is, the coils utilize common flux paths through portions of a single magnetic body.

While a batch fabrication process is illustrated in FIG. 1, it is understood that individual, discrete magnetic components could be fabricated using other processes if desired. That is, the moldable magnetic material may be pressed around, for example, only the desired number of coils for the individual device. As one example, for multi-phase power applications the moldable magnetic material may be pressed around two or more independent coils, providing an integral body and coil structure that may be completed by adding any necessary termination structure.

Figure 2:
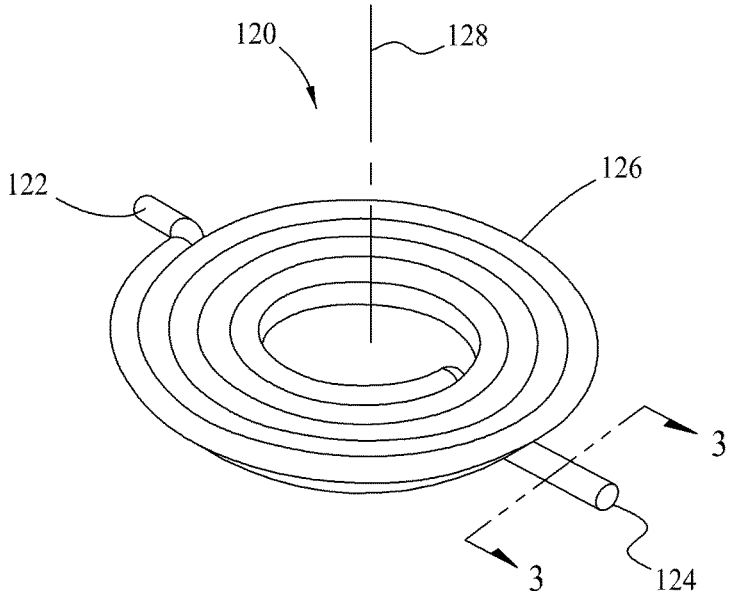
FIG. 2 is a perspective view of a first exemplary coil for the magnetic component assembly shown in FIG. 1.

FIG. 2 is a perspective view of a first exemplary wire coil 120 that may be utilized in constructing magnetic components such as those described above. As shown in FIG. 2, the wire coil 120 includes opposing ends 122 and 124, sometimes referred to as leads, with a winding portion 126 extending between the ends 120 and 122. The wire conductor used to fabricate the coil 120 may be fabricated from copper or another conductive metal or alloy known in the art.

The wire may be flexibly wound around an axis 128 in a known manner to provide a winding portion 126 having a number of turns to achieve a desired effect, such as, for example, a desired inductance value for a selected end use or application of the component. As those in the art will appreciate, an inductance value of the winding portion 126 depends primarily upon the number of turns of the wire, the specific material of the wire used to fabricate the coil, and the cross sectional area of the wire used to fabricate the coil. As such, inductance ratings of the magnetic component may be varied considerably for different applications by varying the number of coil turns, the arrangement of the turns, and the cross sectional area of the coil turns. Many coils 120 may be prefabricated and connected to a lead frame to form the coil layer 110 (FIG. 1) for manufacturing purposes.

Figure 3:
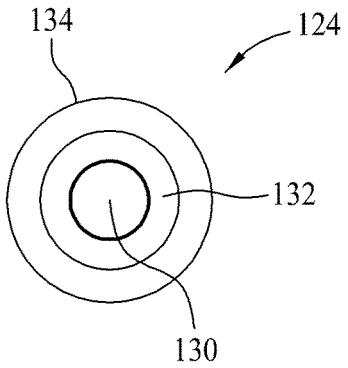
FIG. 3 is a cross sectional view of the wire of the coil shown in FIG. 2.

FIG. 3 is a cross sectional view of the coil end 124 illustrating further features of the wire used to fabricate the coil 120 (FIG. 2). While only the coil end 124 is illustrated, it is understood that the entire coil is provided with similar features. In other embodiments, the features shown in FIG. 3 could be provided in some, but not all portions of the coil. As one example, the features shown in FIG. 3 could be provided in the winding portion 126 (FIG. 2) but not the ends 122, 124. Other variations are likewise possible.

The wire conductor 130 is seen in the center of the cross section. In the example shown in FIG. 3, the wire conductor 130 is generally circular in cross section, and hence the wire conductor is sometimes referred to as a round wire. A high temperature insulation 132 may be provided over the wire conductor 130 to protect the wire conductor during elevated temperatures associated with molding processes as the component assembly is manufactured. As used herein, "high temperature" is generally considered to be temperatures of 260° C. and above. Any insulating material sufficient for such purposes may be provided in any known manner, including but not limited to coating techniques or dipping techniques.

As also shown in FIG. 3, a bonding agent 134 is also provided that in different embodiments may be heat activated or chemically activated during manufacture of the component assembly. The bonding agent beneficially provides additional structural strength and integrity and improved bonding between the coil and the magnetic body. Bonding agents suitable for such purposes may be provided in any known manner, including but not limited to coating techniques or dipping techniques.

While the insulation 132 and bonding agent 134 are advantageous, it is contemplated that they may be considered optional, individually and collectively, in different embodiments. That is, the insulation 132 and/or the bonding agent 134 need not be present in all embodiments.

Figure 4:
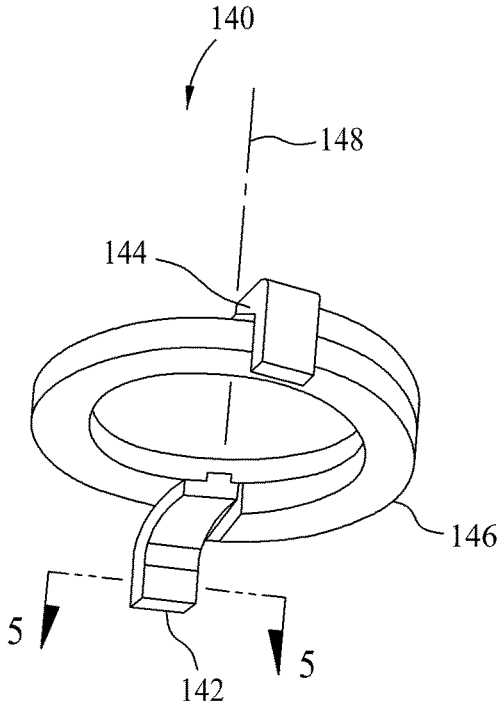
FIG. 4 is perspective view of a second exemplary coil for the magnetic component assembly shown in FIG. 1.

FIG. 4 is a perspective view of a second exemplary wire coil 140 that may be used in the magnetic component assembly 100 (FIG. 1) in lieu of the coil 120 (FIG. 2). As shown in FIG. 4, the wire coil 140 includes opposing ends 142 and 144, sometimes referred to as leads, with a winding portion 146 extending between the ends 142 and 144. The wire conductor used to fabricate the coil 140 may be fabricated from copper or another conductive metal or alloy known in the art.

The wire may be flexibly formed or wound around an axis 148 in a known manner to provide a winding portion 146 having a number of turns to achieve a desired effect, such as, for example, a desired inductance value for a selected end use application of the component.

Figure 5:
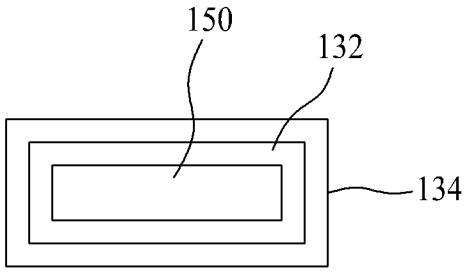
FIG. 5 is a cross sectional view of the wire of the coil shown in FIG. 4.

As shown in FIG. 5, the wire conductor 150 is seen in the center of the cross section. In the example shown in FIG. 5, the wire conductor 150 is generally elongated and rectangular in cross section having opposed and generally flat and planar sides. Hence, the wire conductor 150 is sometimes referred to as a flat wire. The high temperature insulation 132 and/or the bonding agent 134 may optionally be provided as explained above, with similar advantages.

Still other shapes of wire conductors are possible to fabricate the coils 120 or 140. That is, the wires need not be round or flat, but may have other shapes if desired.

Figure 6:
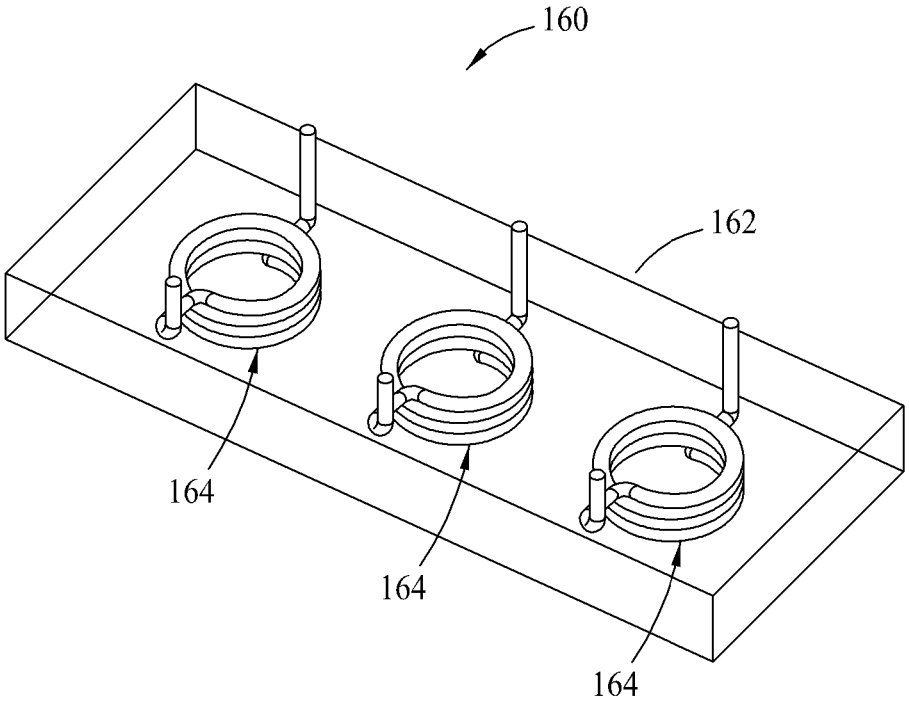
FIG. 6 is a perspective view of a second exemplary magnetic component assembly formed in accordance with an exemplary embodiment of the invention.

FIG. 6 illustrates another magnetic component assembly 160 that generally includes a moldable magnetic material defining a magnetic body 162 and plurality of multi-turn wire coils 164 coupled to the magnetic body. Like the foregoing embodiments, the magnetic body 162 may be pressed around the coils 164 in a relatively simple manufacturing process. The coils 164 are spaced from one another in the magnetic body and are independently operable in the magnetic body 162. As shown in FIG. 6, three wire coils 164 are provided, although a greater or fewer number of coils 164 may be provided in other embodiments. Additionally, while the coils 164 shown in FIG. 6 are fabricated from round wire conductors, other types of coils may alternatively be used, including but not limited to any of those described herein or in the related applications identified above. The coils 164 may optionally be provided with high temperature insulation and/or bonding agent as described above.

The moldable magnetic material defining the magnetic body 162 may be any of the materials mentioned above or other suitable materials known in the art. While magnetic powder materials mixed with binder are believed to be advantageous, neither powder particles nor a non-magnetic binder material are necessarily required for the magnetic material forming the magnetic body 162. Additionally, the moldable magnetic material need not be provided in sheets or layers as described above, but rather may be directly coupled to the coils 164 using compression molding techniques or other techniques known in the art. While the body 162 shown in FIG. 6 is generally elongated and rectangular, other shapes of the magnetic body 162 are possible.

The coils 164 may be arranged in the magnetic body 162 so that there is flux sharing between them. That is, adjacent coils 164 may share common flux paths through portions of the magnetic body.

Figure 7:
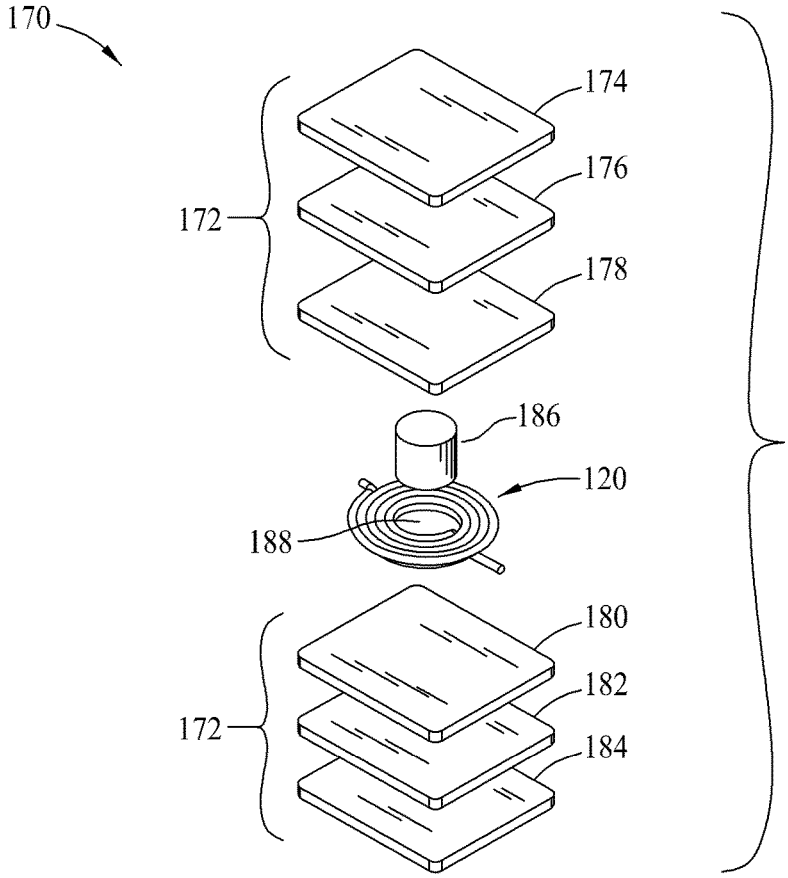
FIG. 7 is a perspective view of a third exemplary magnetic component assembly formed in accordance with an exemplary embodiment of the invention.
Figure 8:
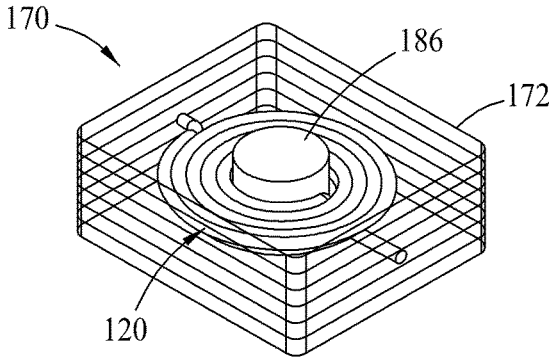
FIG. 8 is an assembly view of the component shown in FIG. 7.

FIGS. 7 and 8 illustrate another magnetic component assembly 170 generally including a powdered magnetic material defining a magnetic body 172 and the coil 120 coupled to the magnetic body. The magnetic body 172 is fabricated with moldable magnetic layers 174, 176, 178 on one side of the coil 120, and moldable magnetic layers 180, 182, 184 on the opposing side of the coil 120. While six layers of magnetic material are shown, it is understood that greater or fewer numbers of magnetic layers may be provided in further and/or alternative embodiments.

In an exemplary embodiment, the magnetic layers 174, 176, 178, 180, 182, 184 may include powdered magnetic material such as any of the powdered materials described above or other powdered magnetic material known in the art. While layers of magnetic material are shown in FIG. 7, the powdered magnetic material may optionally be pressed or otherwise coupled to the coil directly in powder form without prefabrication steps to form layers as described above.

All the layers 174, 176, 178, 180, 182, 184 may be fabricated from the same magnetic material in one embodiment such that the layers 174, 176, 178, 180, 182, 184 have similar, if not identically magnetic properties. In another embodiment, one or more of the layers 174, 176, 178, 180, 182, 184 may be fabricated from a different magnetic material than other layers in the magnetic body 172. For example, the layers 176, 180 and 184 may be fabricated from a first moldable material having first magnetic properties, and layers 174, 178 and 182 may be fabricated from a second moldable magnetic material having second properties that are different from the first properties.

Unlike the previous embodiments, the magnetic component assembly 170 includes a shaped core element 186 inserted through the coil 120. In an exemplary embodiment, the shaped core element 186 may be fabricated from a different magnetic material than the magnetic body 172. The shaped core element 186 may be fabricated from any material known in the art, including but not limited to those described above. As shown in FIGS. 7 and 8, the shaped core element 186 may be formed into a generally cylindrical shape complementary to the shape of the central opening 188 of the coil 120, although it is contemplated that non-cylindrical shapes may likewise be used with coils having non-cylindrical openings. In still other embodiments, the shaped core element 186 and the coil openings need not have complementary shapes.

The shaped core element 186 may be extended through the opening 188 in the coil 120, and the moldable magnetic material is then molded around the coil 120 and shaped core element 186 to complete the magnetic body 172. The different magnetic properties of the shaped core element 186 and the magnetic body 172 may be especially advantageous when the material chosen for the shaped core element 186 has better properties than the moldable magnetic material used to define the magnetic body 172. Thus, flux paths passing though the core element 186 may provide better performance than the magnetic body otherwise would. The manufacturing advantages of the moldable magnetic material may result in a lower component cost than if the entire magnetic body was fabricated from the material of the shaped core element 186.

While one coil 120 and core element 186 is shown in FIGS. 7 and 8, it is contemplated that more than one coil and core element may likewise be provided in the magnetic body 172. Additionally, other types of coils, including but not limited to those described above or in the related applications identified above, may be utilized in lieu of the coil 120 as desired.

Figure 9:
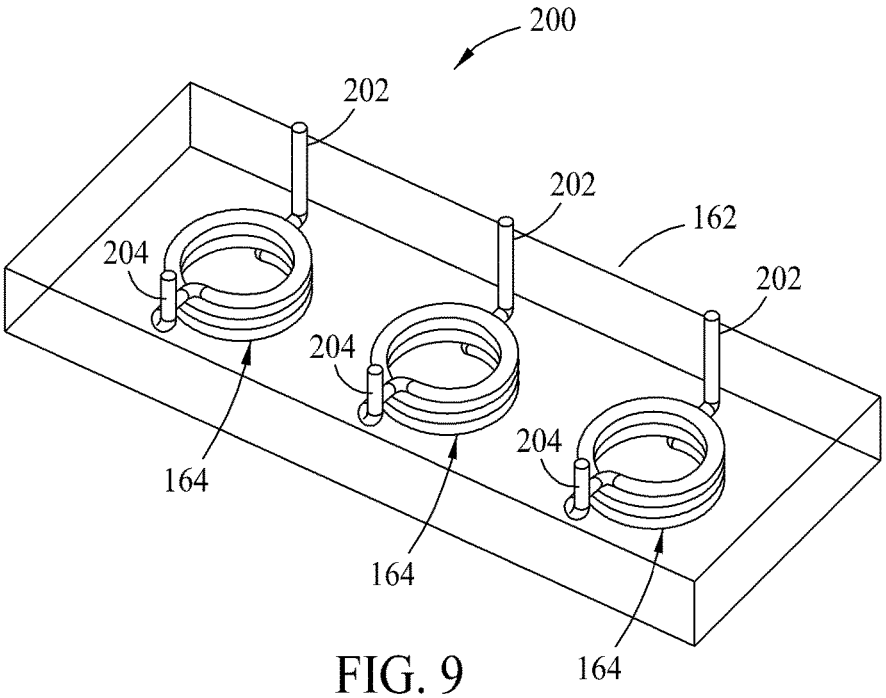
FIG. 9 is a perspective view of a fourth exemplary magnetic component assembly formed in accordance with an exemplary embodiment of the invention.
Figure 10:
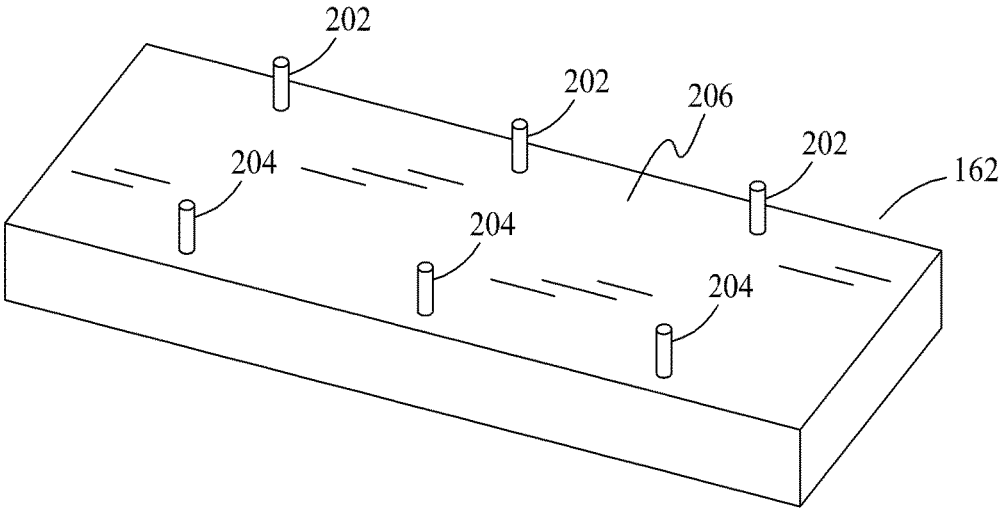
FIG. 10 is a bottom perspective view of the component assembly shown in FIG. 9

FIGS. 9 and 10 illustrate another magnetic component assembly 200 similar to the assembly shown in FIG. 6, but illustrating opposing coil ends 202 and 204 of each coil 164 protruding through a surface 206 of the magnetic body. The coil ends 202, 204 of each coil may be through hole mounted to a circuit board in one embodiment. In another embodiment, the coil ends 202, 204 may be electrically connected to other terminal structure that may then be mounted to a circuit board, including but not limited to the terminal structure discussed below and described in the related applications identified herein.

Figure 11:
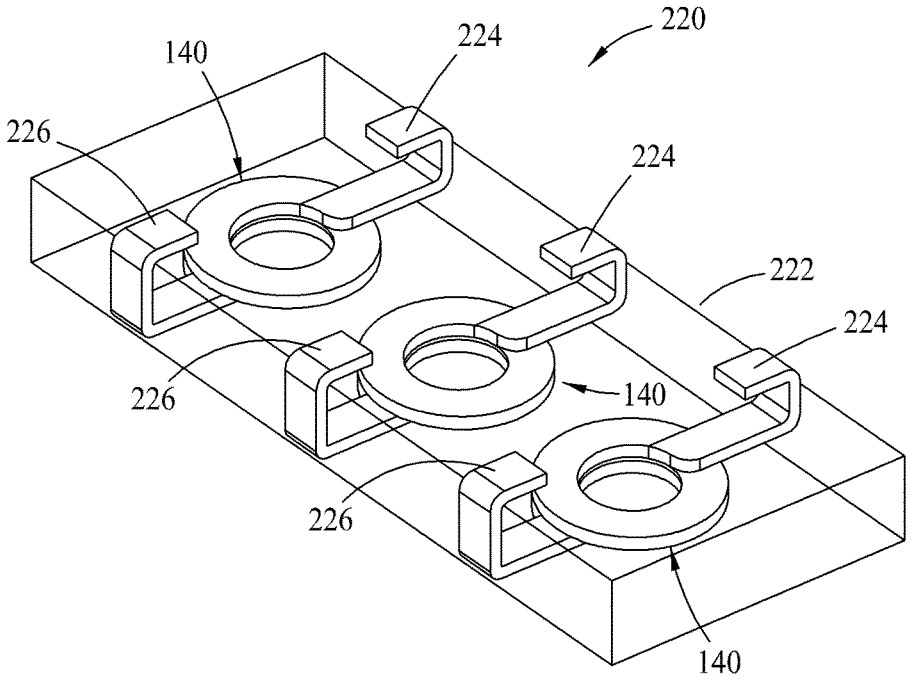
FIG. 11 is a perspective view of a fifth exemplary magnetic component assembly formed in accordance with an exemplary embodiment of the invention.
Figure 12:
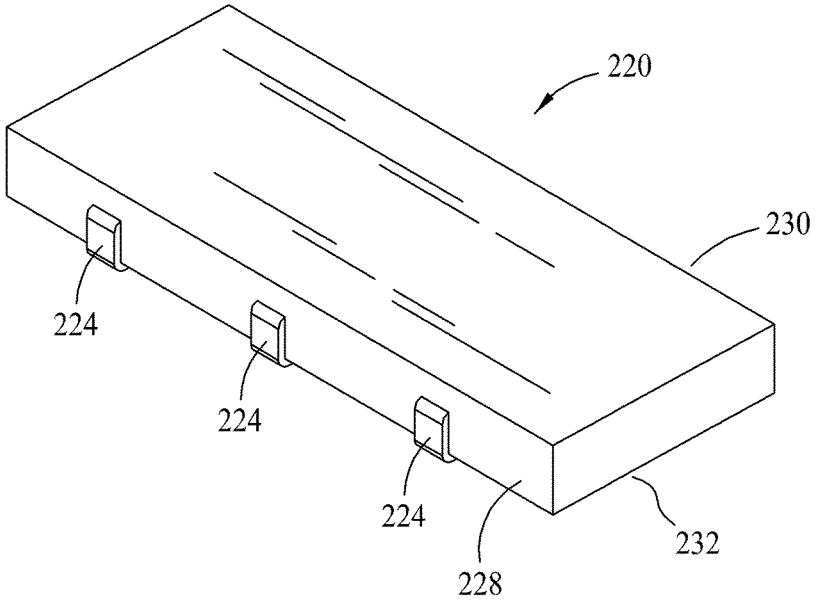
FIG. 12 is a top perspective view of the component assembly shown in FIG. 11.

FIGS. 11 and 12 illustrate another magnetic component assembly 220 including a plurality of coils 140 and a magnetic body 222 pressed around the coils 140. The magnetic body 222 may be fabricated from any of the moldable magnetic materials described above. The distal ends 224, 226 of each coil 140 are shaped to wrap around side edges 228, 230 of the magnetic body and extend to a bottom surface 232 of the body 222 where they may be surface mounted to a circuit board. The wrap around portions of the distal ends 224, 226 may be integrally provided in the core construction or separately provided and attached to the coils 140 for termination purposes.

Figure 13:
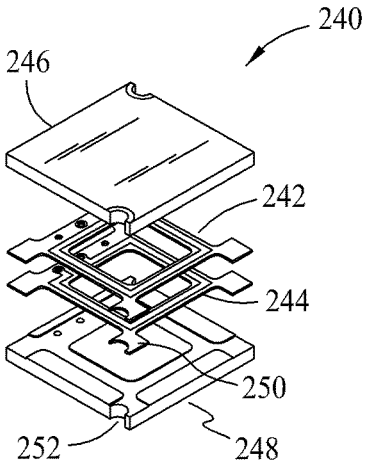
FIG. 13 is an exploded view of a sixth exemplary magnetic component assembly formed in accordance with an exemplary embodiment of the invention.

FIG. 13 illustrates a magnetic component assembly 240 including coils 242 fabricated using flexible circuit board techniques. Layers of moldable magnetic material, such as those described above, may be pressed around and coupled to the coils 242, 244 to define a magnetic body containing the coils 242, 244.

While two coils are illustrated in FIG. 13, it is appreciated that greater or fewer numbers of coils may be provided in other embodiments. Additionally, while generally square shaped coils 242, 244 are shown in FIG. 13, other shapes of coils are possible and could be utilized. The flexible printed circuit coils 242, 244 may be positioned in a flux sharing relationship within the magnetic body.

The flexible circuit coils 242, 244 may be electrically connected via termination pads 250 and metalized openings 252 in the sides of the magnetic body in one example, although other termination structure may alternatively be used in other embodiments.

Figure 14:
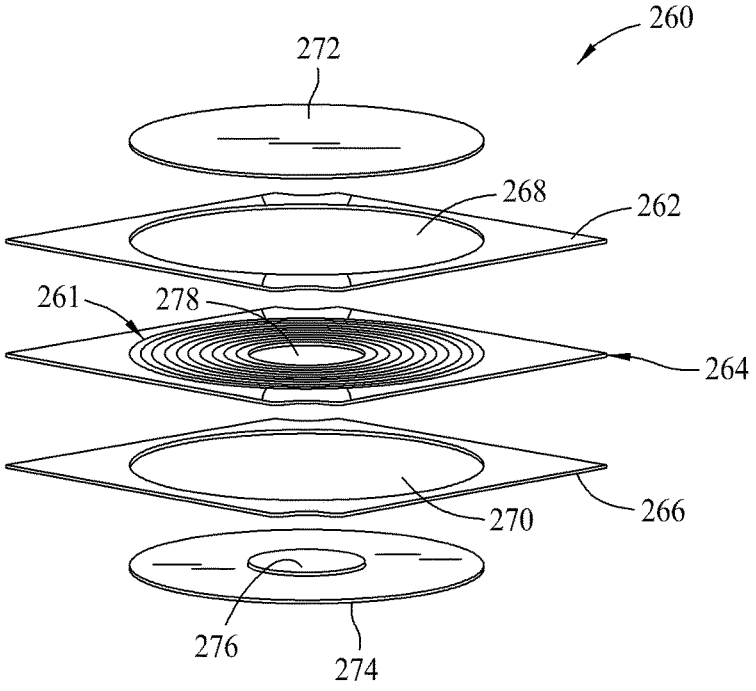
FIG. 14 is an exploded view of a seventh exemplary magnetic component assembly formed in accordance with an exemplary embodiment of the invention.

FIG. 14 illustrates another magnetic component assembly 260 including a flexible printed circuit coil 261 and moldable magnetic material layers 262, 264 and 266. The magnetic materials are moldable, and may be fabricated from any of the materials discussed above. The magnetic material layers may be pressed around the flexible printed circuit coil 261 and secured thereto.

Unlike the assembly 240 shown in FIG. 13, the assembly 260 includes, as shown in FIG. 14, openings 268, 270 formed in the layers 262, 264. The openings receive shaped core elements 272, 274 that may be fabricated from a different magnetic material than the magnetic layers 262, 264 and 266. The core element 274 may include center boss 276 that extends through an opening 278 in the coil 261. The core elements 272 and 274 may be provided before or after the magnetic body is formed with the magnetic layers.

It is recognized that greater or fewer numbers of layers may be provided in other embodiments than shown in FIG. 14. Additionally, more than one coil 261 could be provided, and the coils 261 may be double-sided. Various shapes of coils may be utilized.

While the embodiments shown in FIGS. 13 and 14 are fabricated from magnetic layers, they alternatively could be fabricated from magnetic powder materials directly pressed around the flexible printed circuit coils without first being formed into layers as described above.

Figure 15A:
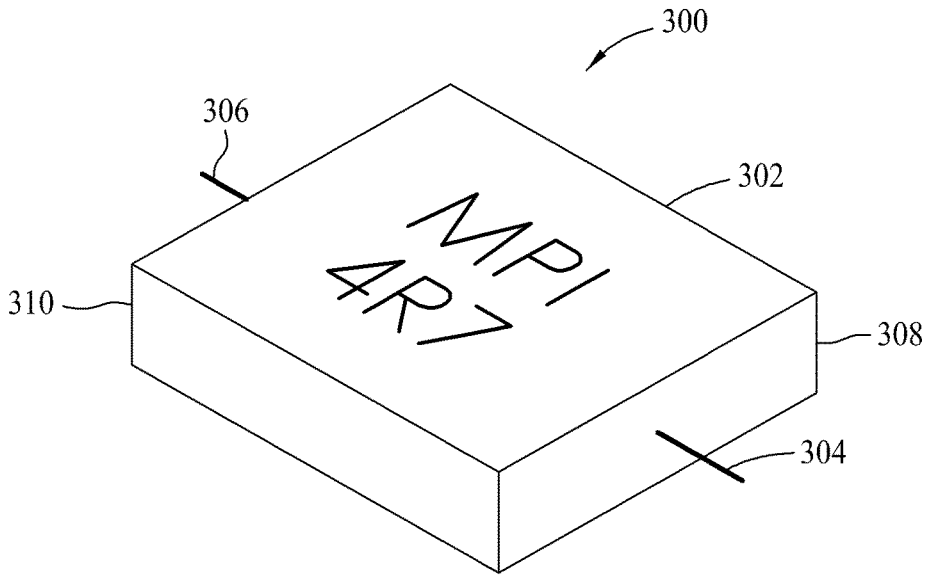
FIGS. 15A, 15B, 15C, and 15D represent respective manufacturing stages of a magnetic component assembly according to an exemplary embodiment of the present invention.

FIGS. 15A, 15B, 15C and 15D respectively represent manufacturing stages of applying terminal structure to a magnetic component assembly 300 having magnetic body 302 formed around a coil such as those described above. The opposing ends or leads 304, 306 of the coil protrude from and extend beyond opposing edges or faces 308, 310 of the magnetic body 302 after the magnetic body 302 is formed as shown in FIG. 15A. The coil ends 304 and 306 are therefore exposed external to the magnetic body 302 for termination purposes. While the coil ends 304, 306 are shown and round wire conductors, other shapes of the coil ends are possible with other types of coils and may alternatively be utilized. Additionally, in an exemplary embodiment, the coil and its coil ends 304, 306 may be fabricated from a copper conductor provided with a barrier coating, although other conductive materials may be utilized if desired.

Figure 15B:
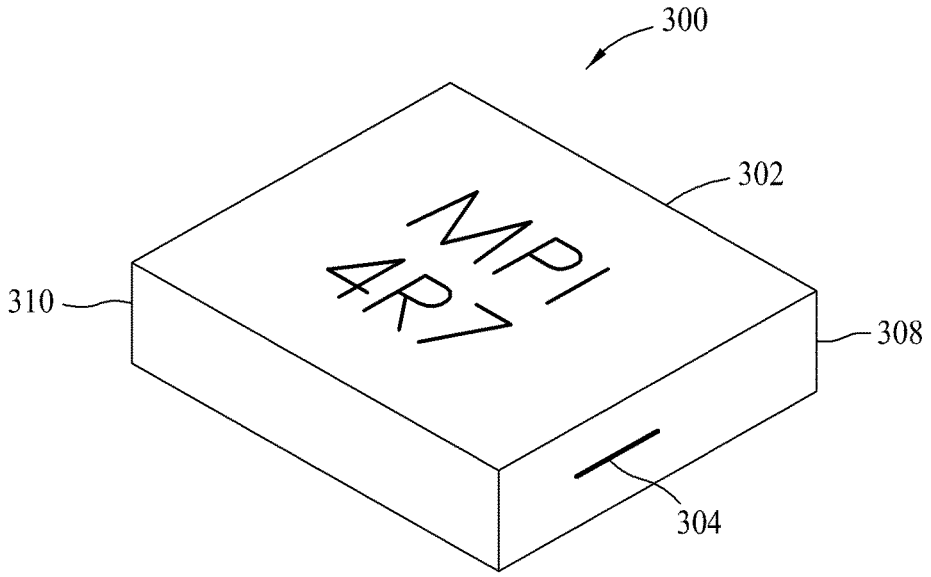

As shown in FIG. 15B, the coil ends 304, 306 are bent or folded to extend generally parallel to and substantially flush with the side edges 308, 310 of the magnetic body 302.

Figure 15C:
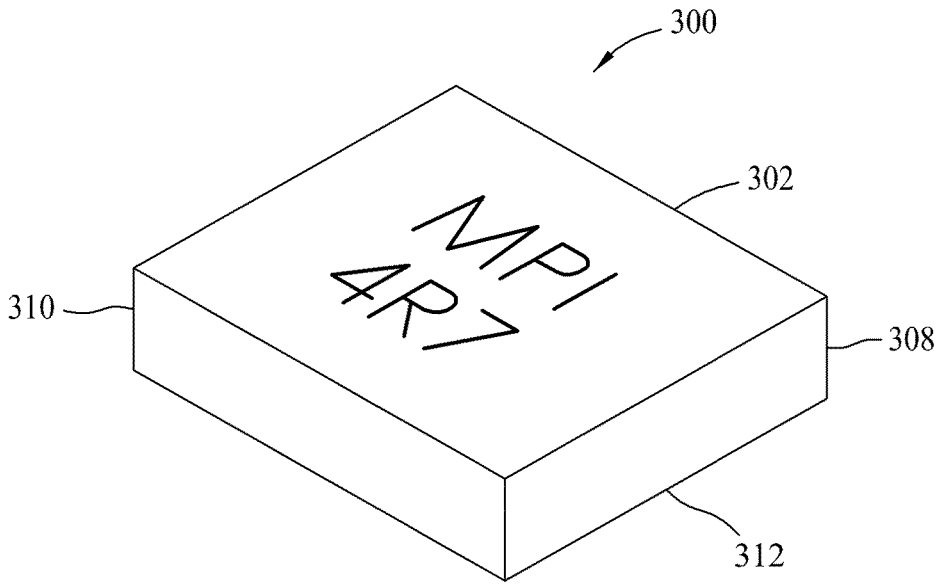

As shown in FIG. 15C, the side edges 308, 310 of the body 302 are metalized, forming a thin layer of conductive material 312 on the side edges 308, 310. The conductive material layer 312 covers and establishes electrical connection with the folded coil ends 304, 306 (FIG. 15B). The conductive material layer 312 may be formed by dipping the edges in a metal bath in one example, or by other techniques known in the art.

Figure 15D:
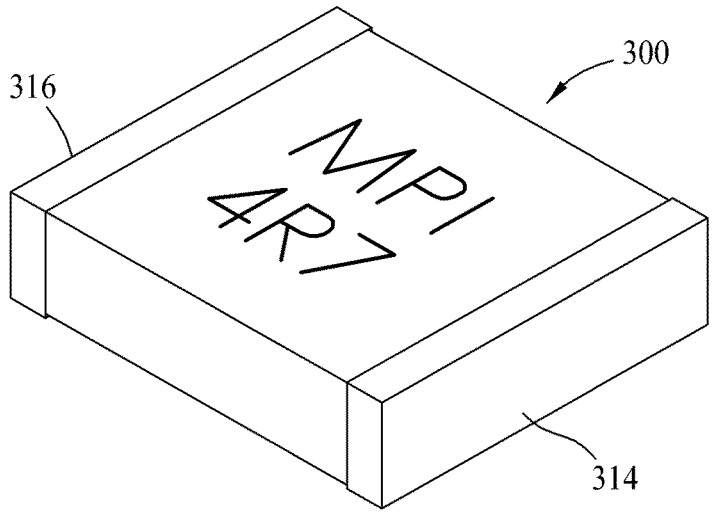

As shown in FIG. 15D, plated wrap around terminations 314, 316 may then be formed over the metalized surfaces shown in FIG. 15C. The terminations 314, 316 may include a nickel/tin (Ni/Sn) plating construction for optimally connectivity with a circuit board. Once the terminations 314, 316 are formed, the component 300 may be surface mounted to a circuit board.

Figure 16:
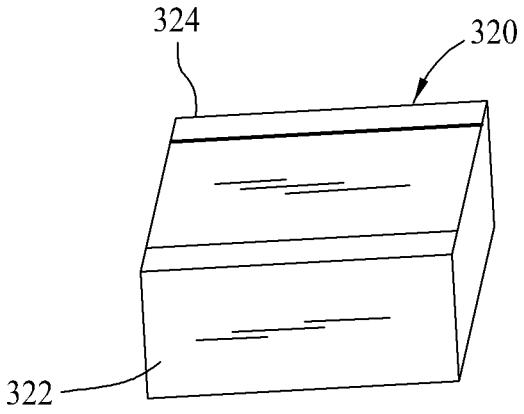
FIG. 16 is an end view of the magnetic component shown in FIG. 15.

In another embodiment, and as shown in FIG. 16, a distal end of a coil lead 320 may be provided with an interface material 322 to facilitate electrical connections to the coil lead 320. In exemplary embodiments, the interface material 322 is a conductive material that is different from the conductive material used to fabricate the coil conductor 324. The interface material 322 may be provided solely on the end surface of the coil lead 320 as shown, or may be applied to the end surfaces and one or more of the side surfaces of the coil lead 320 adjacent the end surface. In different embodiments, the interface material 322 is a liquid electrically conductive material. In another embodiment, the interface material 322 is an electro-deposited metal. Still other known interface materials are possible and may be used.

The interface material technique may be applied to any of the coils described, on one or both of the opposing ends or leads of a coil to improve electrical connections to the coil. While a flat conductor is shown in FIG. 16, other shapes of conductors are possible. Once the interface material 322 is provided, the coil ends may attached to termination structure for making surface mount connections to a circuit manner using any of the termination structure or techniques described herein, any termination structure or technique described in the related applications identified above, or via other known termination structures or techniques.

Figure 17:
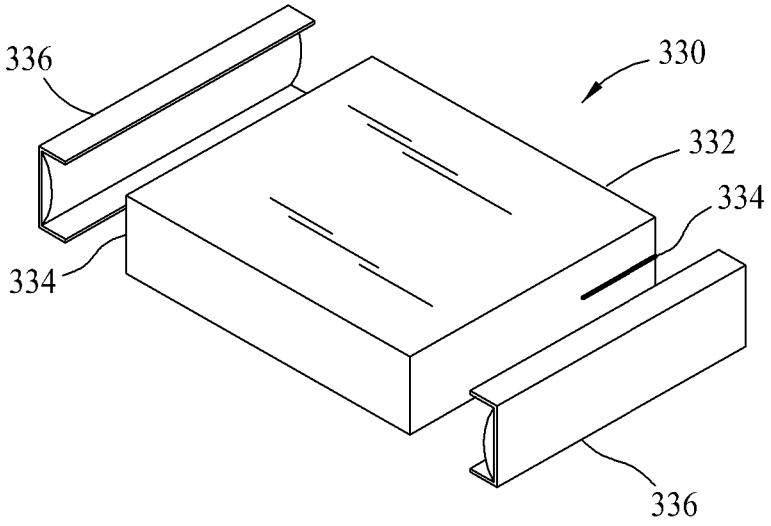
FIG. 17 is a partial exploded view of a ninth exemplary magnetic component assembly formed in accordance with an exemplary embodiment of the invention.

FIG. 17 illustrates another embodiment of a magnetic component assembly 330 having a magnetic body 332 and a coil therein with coil ends 334 exposed on exterior surfaces of the magnetic body 332. In the example shown, the magnetic body 332 and the coil ends are similar to that shown in FIG. 15B wherein the coil ends are bent or folded back onto the respective surfaces of the magnetic body 332, although this is by no means necessary and the coil ends may be exposed and or positioned in another manner as desired. As shown in FIG. 17, conductive terminal clips 336 are provided over the exposed coil ends 334 to establish electrical connections thereto.

In the embodiment illustrated in FIG. 17, the terminal clips 336 are stamped metal structures formed into a generally C-shaped or channel configuration that may be fitted over the side edges of the magnetic body 332 wherein the coil ends 334 are exposed. The inner surface of the terminal clips 336 may electrically connected to the coil ends using, for example, solder reflow techniques or other techniques known in the art. Interface materials such as those described above may optionally be used to help make the electrical connections. While particular terminal clips 336 are shown in FIG. 17, other shapes of terminal clips are possible and may be used, including but not limited to the terminal clips described in the related applications identified herein.

In an alternative embodiment, a though hole may be provided in the terminal clips 336 and a portion of the coil ends 334 may be extended through the through hole and fastened to the clip using soldering or welding technique and the like to establish the electrical connection to the clips. Exemplary embodiments of terminal clips including through-holes are described in the related applications identified above, any of which may be utilized.

Figure 18:
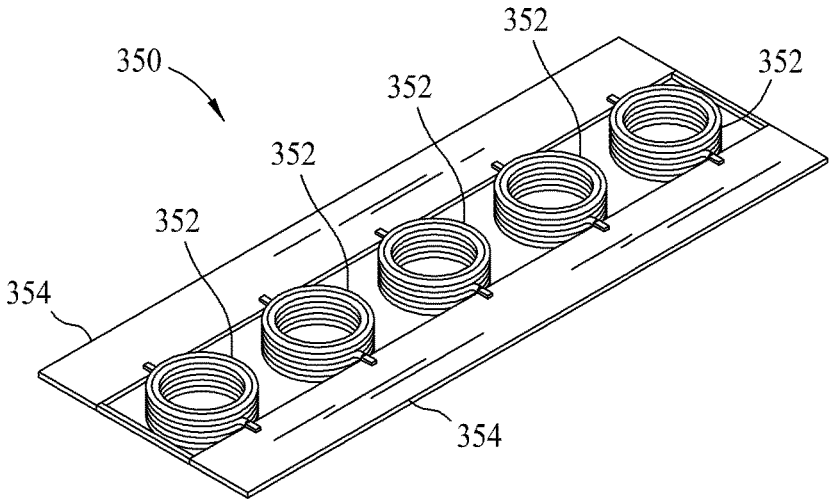
FIG. 18 illustrates a coil assembly in accordance with an exemplary embodiment of the invention.

FIG. 18 illustrates a coil fabrication layer 350 including a plurality of multi-turn wire coils 352 having their ends or leads attached to a lead frame 354. In the example shown, the coils 352 may be separately fabricated and welded to the lead frame 354 for assembly purposes to a magnetic body. While five coils 352 are shown connected to the lead frame 354, greater or fewer numbers of coils (including one) may alternatively be provided and utilized. Additionally, while round wire coils are shown in FIG. 18, flat wire coils or other non-wire coils could alternatively be provided having any number of turns, including fractional turns less than a complete turn.

Figure 19:
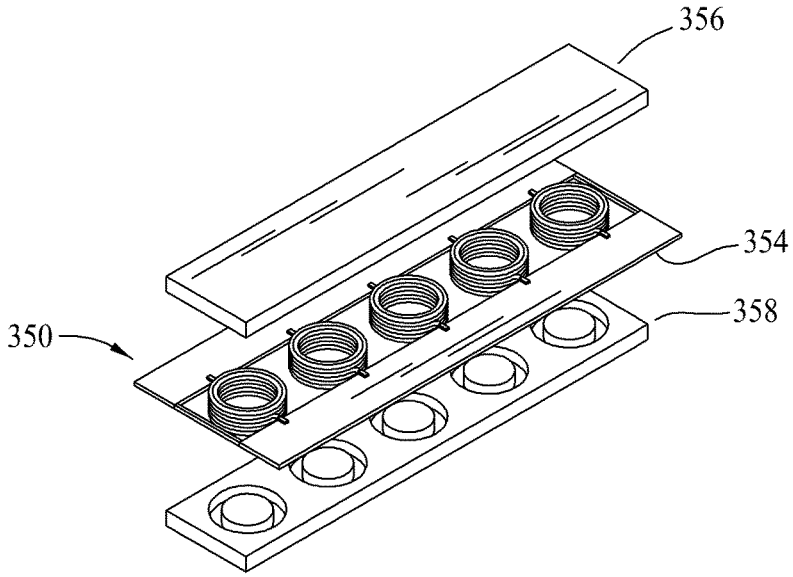
FIG. 19 illustrates the coil assembly shown in FIG. 18 at a second stage of manufacture.

FIG. 19 shows the coil layer 350 being assembled with magnetic material layers 356, 358. The magnetic material layers 356, 358 may be fabricated from any of the materials mentioned above, and may be pressed around the coil fabrication layer 350 to form the magnetic body. The lead frame 354 is larger in dimension than the magnetic layers 356, 358 such that the lead frame 354 overhangs the sides of the magnetic layers during molding processes. The coils connected to the lead frame 354 are surrounded by the magnetic body once it is formed, with a portion of the lead frame 354 protruding from the side edges. The assembly shown in FIG. 19 may then be singulated into discrete devices having the desired number of coils, which may be one, two, three or more coils in various embodiments.

Once molded and singulating processes are accomplished, the excess portions of the lead frame 354 overhanging the sides of the magnetic body may be cut or trimmed back so as to be flush with the sides of the magnetic body. Terminal connections may then be made using any of the techniques described above, in the related applications identified above, or as known in the art.

Figure 20:
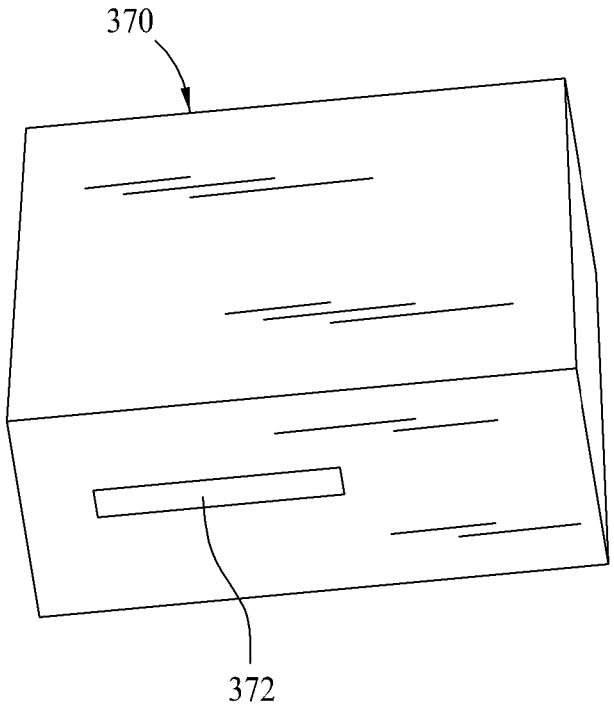
FIG. 20 illustrates another stage of manufacture of the assembly shown in FIG. 19.

FIG. 20 illustrates an example of a magnetic component assembly 370 including exposed but generally flush terminal ends 372 in the sides magnetic body. The terminal ends 372 may be the distal ends of a coil or a lead frame as described above. The flush terminal ends 372 may facilitate connections to terminal structures such as those described above. Interface materials such as those described above may optionally be provided on the flush terminal ends 372 to facilitate electrical connections thereto.

III. EXEMPLARY EMBODIMENTS DISCLOSED

It should now be evident that the various features described may be mixed and matched in various combinations. For example, wherever wire coils are described, printed circuit coils could be utilized instead. As another example, where round wire coils are described, flat wire coils could be utilized instead. Where layered constructions are described for the magnetic bodies, non-layered magnetic constructions could be utilized instead. Any of the termination structures described could be utilized with any of the magnetic component assemblies. A great variety of magnetic component assemblies may be advantageously provided having different magnetic properties, different numbers and types of coils, and having different performance characteristics to meet the needs of specific applications.

Also, certain of the features described could be advantageously utilized in structures having discrete core pieces that are physically gapped and spaced from another. This is particularly true for some of the termination features and coil coupling features described.

Among the various possibilities within the scope of the disclosure as set forth above, at least the following embodiments are believed to be advantageous relative to conventional inductor components.

An embodiment of a magnetic component assembly has been disclosed including: at least one coil fabricated from a conductive material, the coil including an outer layer of bonding agent that is one of heat activated and chemically activated; and a magnetic body formed around the coil, wherein the bonding agent couples the coil to the magnetic body.

Optionally, the conductive material may be further provided with a high temperature insulating material. The at least one coil may be a multi-turn wire coil. The conductive material may be one of a flat wire conductor and a round wire conductor. The magnetic body may include at least one layer of moldable magnetic material pressed around the coil to form the magnetic body, with the moldable magnetic material comprising magnetic powder particles and a polymeric binder.

The at least one coil may include two or more independent coils arranged in the magnetic body, and the moldable magnetic material may be pressed around the two or more independent coils. The two or more independent coils may be arranged in the magnetic body so that there is flux sharing between the coils.

The magnetic body is formed from a powdered magnetic material. The magnetic body may be formed from a moldable material. The magnetic body may be formed from at least a first and second layer of moldable magnetic material including magnetic powder particles and a polymeric binder, wherein the magnetic material is pressed around the at least one coil, and wherein the first and second layers of magnetic materials have different magnetic properties from one another. The magnetic materials for the first and second layers may be selected from the group of Ferrite particles, Iron (Fe) particles, Sendust (Fe—Si—Al) particles, MPP (Ni—Mo—Fe) particles, HighFlux (Ni—Fe) particles, Megaflux (Fe—Si Alloy) particles, iron-based amorphous powder particles, and cobalt-based amorphous powder particles. A shaped core piece may be coupled to the wire coil, and the moldable material may extend around the at least one wire coil and the shaped core.

The at least one coil may be a flexible printed circuit coil. The magnetic body may include a plurality of layers of magnetic material coupled to the at least one flexible printed circuit coil, with the magnetic moldable material comprising magnetic powder particles and a polymeric binder, and the magnetic material being pressed around the at least one flexible printed circuit coil. The at least one flexible printed circuit coil may include a plurality of flexible printed circuit coils, with the magnetic material being pressed around the plurality of flexible printed circuit coils, and wherein at least two of the plurality of layers of magnetic material are formed from different magnetic materials.

A shaped core piece may be associated with the printed circuit coil, and the magnetic body is formed from a moldable material pressed around the flexible circuit coil and the shaped core piece. The coil may include first and second distal ends, and at least one of the first and second ends may be coated with an electrically conductive liquid material. At least one of the first and second ends may be coated with an electro-deposited metal. Surface mount terminations may be provided on the magnetic body and electrically connected to the respective first and second distal ends. The terminations may be plated on a surface of the magnetic body. The plated terminations my include a Ni/Sn plating.

The first and second distal ends of the coil may each protrude from a respective face of the magnetic body, and the distal ends may be folded against the respective face, and respectively connected to a conductive clip, thereby providing surface mount terminations for the assembly. The distal ends may be one of welded or soldered to the respective conductive clips. Each conductive clip may include a through hole, and the distal ends may be fastened to each clip via the through hole.

The at least one coil may comprise a copper conductor provided with a barrier coating. The assembly may define one of an inductor and a transformer. A lead frame may be connected to the at least one coil within the magnetic body, and the lead frame may be cut flush to the magnetic body. The at least one coil may include opposed distal ends, and the distal ends of the coil may be connected to a termination clip at a location interior to the magnetic body. The magnetic body may be formed from a pre-annealed magnetic amorphous metal powder combined with a polymer binder. The at least one coil may include first and second independent coils arranged in a flux sharing relationship.

IV. CONCLUSION

The benefits of the invention are now believed to be evident from the foregoing examples and embodiments. While numerous embodiments and examples have been specifically described, other examples and embodiments are possible within the scope and spirit of the exemplary devices, assemblies, and methodology disclosed.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. An electromagnetic component assembly comprising:

at least one prefabricated conductive coil including an outer layer of bonding agent that is one of heat activated and chemically activated; and a laminated magnetic body having distributed gap properties throughout, the laminated magnetic body formed around the at least one coil, wherein the bonding agent couples the at least one coil to the laminated magnetic body, wherein the laminated magnetic body comprises a plurality of stacked prefabricated layers of magnetic material pressed in surface contact with one another, wherein each of the prefabricated layers of magnetic material comprises magnetic powder particles and a polymeric binder shaped into a thin sheet, wherein the at least one prefabricated coil comprises a freestanding element formed apart from all of the prefabricated layers of magnetic material, wherein two of the stacked prefabricated layers of magnetic material are positioned on opposing sides of the at least one prefabricated coil and sandwich the at least one prefabricated coil in between, and wherein the at least one coil and laminated magnetic body define a direct current power inductor for powering an electronic device.

2. The electromagnetic component assembly of claim 1, wherein the at least one coil is further provided with a high temperature insulating material.

3. The electromagnetic component assembly of claim 1, wherein the at least one coil comprises a multi-turn wire coil.

4. The electromagnetic component assembly of claim 1, wherein the at least one coil includes one of a flat wire conductor and a round wire conductor.

5. The electromagnetic component assembly of claim 1, wherein the at least one coil comprises two or more independent coils arranged in the laminated magnetic body.

6. The electromagnetic component assembly of claim 5, wherein the two or more independent coils are arranged in the laminated magnetic body so that there is flux sharing between the two or more independent coils.

7. The electromagnetic component assembly of claim 1, wherein the laminated magnetic body is molded around the at least one coil.

8. The electromagnetic component assembly of claim 1, wherein at least two of the plurality of stacked prefabricated layers have different magnetic properties from one another.

9. The electromagnetic component assembly of claim 8, wherein at least one of the plurality of stacked prefabricated layers includes a magnetic metal powder.

10. The electromagnetic component assembly of claim 1, further comprising a shaped core piece coupled to the at least one coil, wherein the laminated magnetic body extends around the at least one coil and the shaped core, and wherein the shaped core piece is provided separately from the plurality of stacked prefabricated layers.

11. The electromagnetic component assembly of claim 1, wherein the at least one coil comprises a flexible printed circuit coil.

12. The electromagnetic component assembly of claim 11, wherein the at least one flexible printed circuit coil comprises a plurality of flexible printed circuit coils, the laminated magnetic body being formed around the plurality of flexible printed circuit coils, wherein at least two of the plurality of stacked prefabricated layers include different magnetic materials.

13. The electromagnetic component assembly of claim 11, further comprising a shaped core piece associated with the printed circuit coil, and wherein the laminated magnetic body is formed around the flexible circuit coil and the shaped core piece.

14. The electromagnetic component assembly of claim 1, wherein the at least one coil includes first and second distal ends, at least one of the first and second ends coated with an electrically conductive liquid material.

15. The electromagnetic component assembly of claim 1, wherein the at least one coil includes first and second distal ends, at least one of the first and second ends coated with an electro-deposited metal.

16. The electromagnetic component assembly of claim 1, wherein the at least one coil includes first and second distal ends, the assembly further comprising surface mount terminations provided on the laminated magnetic body and electrically connected to the respective first and second distal ends, the terminations being plated on a surface of the laminated magnetic body.

17. The electromagnetic component assembly of claim 16, wherein the plated terminations include a Ni/Sn plating.

18. The electromagnetic component assembly of claim 1, wherein the coil includes first and second distal ends each protruding from a respective face of the laminated magnetic body, the distal ends being folded against the respective face, and the distal ends being respectively connected to a conductive clip, thereby providing surface mount terminations for the assembly.

19. The electromagnetic component assembly of claim 18, the distal ends being one of welded or soldered to the respective conductive clips.

20. The electromagnetic component assembly of claim 18, wherein each conductive clip includes a through hole, and the distal ends being fastened to each clip via the through hole.

21. The electromagnetic component assembly of claim 1, wherein the at least one coil comprises a copper conductor provided with a barrier coating.

22. The electromagnetic component assembly of claim 1, further comprising a lead frame connected to the at least one coil within the laminated magnetic body, and the lead frame being cut flush to the magnetic body.

23. The electromagnetic component assembly of claim 1, wherein the at least one coil includes opposed distal ends, the distal ends of the coil being connected to a termination clip at a location interior to the laminated magnetic body.

24. The electromagnetic component assembly of claim 1, wherein the laminated magnetic body is formed from a pre-annealed magnetic amorphous metal powder combined with a polymer binder.

25. The electromagnetic component assembly of claim 1, wherein the at least one coil comprises a three dimensional element.

26. An electromagnetic component assembly comprising:

at least one prefabricated coil having a winding portion defining more than complete turn; and a laminated magnetic body having distributed gap properties throughout, the laminated magnetic body formed around the at least one coil and comprising a plurality of stacked prefabricated layers of magnetic material each being pressed in surface contact with at least one other of the plurality of stacked prefabricated layers of magnetic material, wherein each of the prefabricated layers of magnetic material comprises magnetic powder particles and a polymeric binder shaped into a thin sheet, wherein the at least one prefabricated coil comprises a freestanding conductive element formed apart from all of the prefabricated layers of magnetic material, wherein two of the stacked prefabricated layers of magnetic material are positioned on opposing sides of the at least one prefabricated coil and sandwich the at least one prefabricated coil in between, and wherein the at least one coil and laminated magnetic body define a direct current power inductor for powering an electronic device.

27. The electromagnetic component assembly of claim 26, wherein the at least one prefabricated coil includes an outer layer of bonding agent that is one of heat activated and chemically activated.

28. The electromagnetic component assembly of claim 26, further comprising surface mount terminations provided on the laminated magnetic body.

29. The electromagnetic component assembly of claim 26, wherein the freestanding conductive element comprises one of a round wire conductor and a flat wire conductor.

30. The electromagnetic component assembly of claim 26, wherein the at least one prefabricated coil comprises a plurality of prefabricated coils spaced apart from one another in the laminated magnetic body.

31. The electromagnetic component assembly of claim 26, further comprising a prefabricated, shaped core element separately provided from the at least one prefabricated coil and the plurality of stacked prefabricated layers of magnetic material, wherein the prefabricated, shaped core element extends through the at least one prefabricated coil and is enclosed within the laminated magnetic body.

* * * * *